US005862534A

United States Patent [19]

Clay

[11] Patent Number: 5,862,534

[45] Date of Patent: Jan. 26, 1999

[54] TOILET DRAIN CLEANING TOOL

[76] Inventor: William Clay, 101 Tuytenbridge Rd., Lake Katrine, N.Y. 12449

[21] Appl. No.: 413,377

[22] Filed: Mar. 30, 1995

[51] Int. Cl.[6] ..... E03D 9/00

[52] U.S. Cl. ..... 4/255.01; 15/104.16

[58] Field of Search ..... 4/255.01–255.12; 15/104.16, 104.31, 104.33

[56] References Cited

U.S. PATENT DOCUMENTS

| | | | |
|---|---|---|---|
| 1,137,580 | 4/1915 | Cole | 4/255.08 X |
| 1,175,256 | 3/1916 | Gruver | 15/104.16 |
| 2,730,469 | 1/1956 | Harwedel | 15/104.16 X |
| 5,249,311 | 10/1993 | Rau | 4/255.05 |

*Primary Examiner*—Robert M. Fetsuga
*Attorney, Agent, or Firm*—Martin J. Spellman, Jr.

[57] ABSTRACT

A drain pipe obstruction clearing tool comprising an exterior cylinder having a plunger like head, a closed upper end with an aperture therein sliding and sealing engagement with a reciprocating handle shaft. The plunger face has a central aperture therein. Slidable through the central aperture of the plunger is a flexible hose-like piece that is normally retained within the outer cylinder in the stored condition. In the operative condition it extends its full length outwardly through the aperture in the plunger and is adapted to snake its way through the drain passage to the stoppage.

3 Claims, 2 Drawing Sheets

10
8
6
16
42
40
36
38
33
22
26
30
12
32
18
20
14
34
23
28

TOILET DRAIN CLEANING TOOL

BACKGROUND OF THE INVENTION

1. Field of the Invention

The present invention is concerned with a tool for quickly and neatly removing stoppages in waste line drains in the areas of the traps and, in particular, for clearing blockages in toilet fixtures. The clearance of obstructions in drain lines of various fixtures, in particularly household toilets, is a common need in most households and often a very distasteful chore accomplished using either plumber snakes, make shift snakes, plungers or repeated flushing with lots of hope that the blockage is cleared without an overflow of the appliance. In the case of using a snake the length of the snake is exposed to the products in the line and it is distasteful and difficult to handle and to operate for the average homeowner. The plunger approach is less onerous and easier to clean but is often not too effective in clearing the blockage and can cause the splashing of waste waters and the consequent necessity of cleaning up the toilet and its surrounding areas. There is a need for a household tool that is easy to use, inexpensive, simple in construction, and is completely effective in clearing blocked household plumbing fixture drains.

2. Prior Art

Applicant is not aware of any previous development which accomplishes the objectives of the present invention in the same manner using such a simple, clean, convenient tool.

The Heidelberg U.S. Pat. No. 1,495,303 Trap Flushing Device shows spring like feet extending from a plunger to steady it in the pipe to be cleared. Hose extensions comprise flushing nozzles and the object is to get the flushing fluid near the blockages.

Allender U.S. Pat. No. 1,574,274 is simply a rudimentary hand pump within the upper portion of the plunger cylinder handle. Other variations of the common plunger pump are A. G. Norton U.S. Pat. No. 1,706,315. and Colemen U.S. Pat. No. 2,498,359.

A typical snake device incorporated into a plunger head is shown in Dunn U.S. Pat. No. 4,174,548 in an opening passing through a plunger head. It includes an elongated hollow grip member formed with an opening extending from one end to the other and an elongated operating element such as a flexible snake or retriever tool or the like disposed within the opening to be moved therein. The grip member serves to steady the operating element as the operating element is manipulated. Upon removal of the operating element a force cup carried at one end of the grip member serves to form a plunger.

A very elaborate clean out and snaking device is shown in U.S. Pat.No. 5,056,177 Nast. A flexible hollow conduit or curved tube is placed in the toilet and the snake extends therethrough.

Another version of the hand pump plunger combination is shown in U.S. Pat. No. 5,199,114 Christopher.

Meyer U.S. Pat. No. 2,697,842 shows a combination of hand and air force pressure pump and plunger. The plunger can be reversed on the base stem of the pump and a flexible hose extends therefrom. It is not indicated to be of use in physically clearing the blockage and there is no relation to the manner in which the apparatus of this application is constructed or operates.

SUMMARY OF THE INVENTION

In accordance with the present invention a tool is provided for readily clearing obstructions near the trap in household drainage pipes especially blockages of toilet fixtures. The tool is relatively simple in construction, easy to use, easy to clean, produces reliable results and is effective in clearing practically any possible stoppage.

The present invention is a drain pipe obstruction clearing tool comprising an exterior cylinder having a plunger like head, a closed upper end with an aperture therein in sliding and sealing engagement with a reciprocating handle shaft. The plunger face has a central aperture therein. Slidable through the central aperture of the plunger is a flexible hose-like piece that is normally retained within the outer cylinder in the stored condition. In the operative condition it extends its full length outwardly through the aperture in the plunger and is adapted to snake its way through the drain passage. The hose is made of heavy rubber and is yieldingly flexible but sufficiently strong so that within the confines of the drains it will not fold back upon itself. The rubber may be lubricated to facilitate sliding through the sealing opening in the plunger face. The inner end of the hose is secured to a piston like fixture. The upper end of the piston fixture is in sliding contact with the interior walls of the outer cylinder.

The top of the cylinder is closed but the closure center has a bore in it through which the handle shaft slides in sealing engagement. The lower half of the handle shaft is provided with a transverse pin(s) extending outwardly from the circumference of the shaft sufficiently to engage detents on the outer periphery of the end fixture of the handle shaft. The pins serve to allow the shaft to pull back on the hose and with a twist, the pin fits into a detent in the fixture to permit the shaft, when pushed downwardly, to extend a downward force on the hose to push the hose through the opening in the plunger head and extend therefrom.

After the stoppage is cleared by the force of the forward motion of the hose, the shaft is withdrawn and turned a half turn to disengage from the detents, and then it is pushed downwardly to be stored concentrically within the hose and the outer cylinder.

Thus, the present invention provides a very simple, inexpensive, easy to use, neat, and easily cleaned device for clearing stoppages in drains, particularly those in household plumbing fixtures, and especially toilets.

BRIEF DESCRIPTION OF THE DRAWING

In the accompanying drawing which forms a part of this specification.

ILLUSTRATIVE SPECIFIC EMBODIMENT

Figure 1:
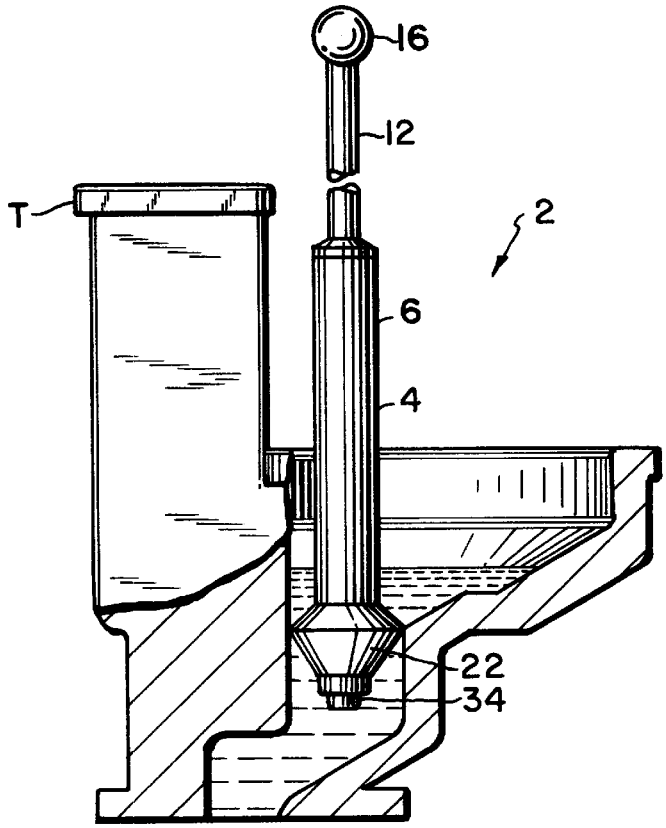
FIG. 1 is a household toilet in section with the tool of the present invention in place at the top of the drain opening.
Figure 2:
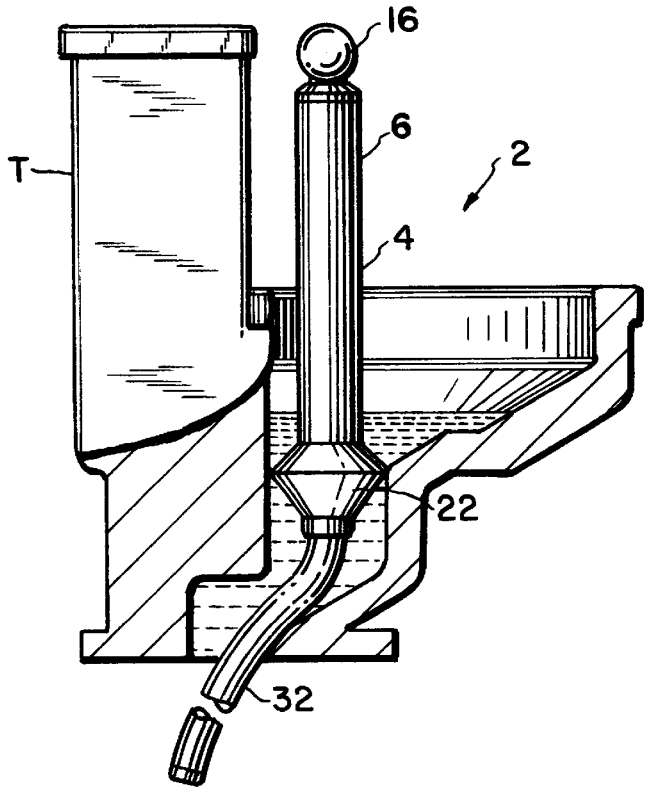
FIG. 2 shows the same fixture with the clearing flexible tubing of the tool extended down into the drain to clear any stoppage.
Figures 3, 4, 5:
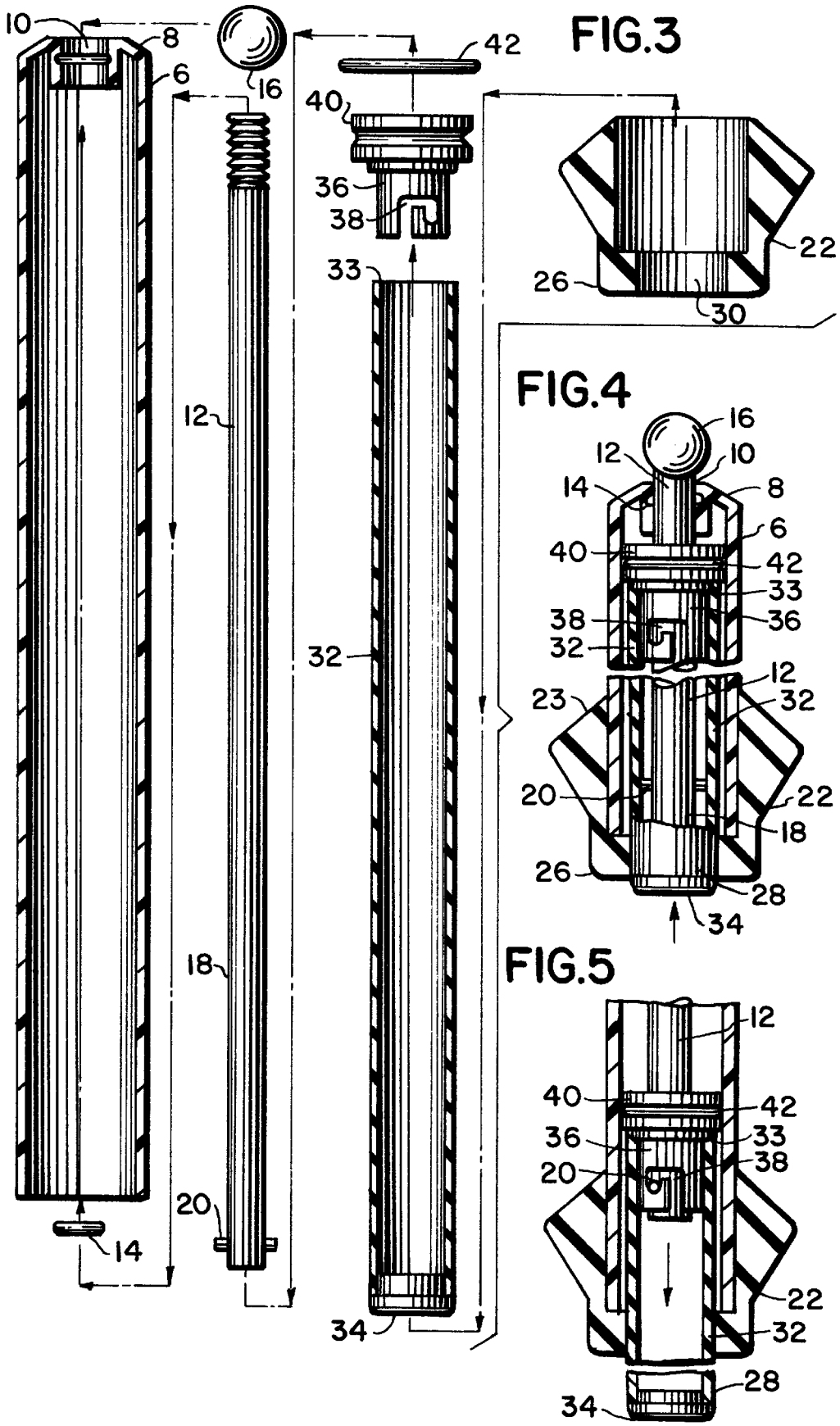
FIG. 3 is an expanded view, partially in section, showing the assembly of the various components of the tool of the present invention.
FIG. 4 is a sectional view of the device showing the respective positions of the parts in the stored condition.
FIG. 5 is a sectional view showing the position of the working parts of the device when activated.

The device 2 includes an outer tube 4 approximately 1 & ½ to 2 inches in diameter and 18 to 24 inches in length and is generally fabricated of PVC rigid tubing. The top end 6 is closed by a cap 8 having an annular aperture 10 therein for the handle shaft 12 to slide there through. A seal means in the form of a washer 14 can be provided on the inner surface of the cap 8.

The outer end of the shaft 12 is threaded to receive correspondingly internally threaded handle 16. The lower end 18 of the shaft 12 is provided with a transverse pin 20 extending approximately ½ inch on each side of the shaft 12. The lower end of the outer tube 4 is enclosed by a rubber plunger head 22. The upper end 23 of the plunger head 22 is friction fitted over the outside of the tube 4 and can be strapped exteriorly if necessary.

The plunger 22 has the general shape shown which serves to provide an air seal at the base of the drain passage that is to be cleared. The outer end 26 is provided with an opening 30 which is dimensioned to be in sliding and sealing engagement with a flexible rubber hose 32 having its outer end 28 closed by rounded plug 34. The flexible hose 32 is approximately 12 to 18 inches in length and 1 to 1 & ½ inches in diameter. The inner end 33 of the hose 32 has a fixture 36 with the detents 38 as shown to coact with the pin 20 on the lower end of the handle shaft 12. The outer side is provided with a ring bushing 40 and an "O" ring 42 around the outer rim of it to be in sliding and sealing engagement with the interior of the internal surface of the tube 4.

In the stored condition the shaft 12 extends downward within the flexible rubber hose 32.

To operate, the device 2 is placed in the toilet with plunger 22 firmly in place, the shaft 12 is withdrawn to its full length, turned to engage the detents 38, and shoved forward thereby extending hose 32 outwardly through the opening 30 in the plunger seal 22 as shown. Once the drain is cleared, the hose 32 is withdrawn back into the cylinder 4. The end 28 thereof then is coterminous with the plunger end 26.

The handle shaft 12, having been pulled back, is turned to disengage the pins 20 from the end fixture 36 and then the shaft 12 pushed downwardly into the storage position within the hose 32 and the cylinder 4. This is the same position as it started.

This device 2 basically can clear almost any stoppage in a toilet drain short of concrete and is easily constructed and easy to operate without undo strength being required. It stores neatly and sanitarily after usage.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A drain cleaning tool comprising a cylindrical enclosure having a first end thereof closed by a plunger head having an aperture centrally located therein, through which a flexible hose may be extended from and retracted within said cylindrical enclosure, a shaft within said cylindrical enclosure for selectively acting to push said hose outwardly and pull said hose inwardly, and said shaft being adapted to be stored concentrically within said hose and said cylindrical enclosure.

2. A tool as claimed in claim 1 wherein a second end of said cylindrical enclosure has a closure with central aperture through which said shaft slides in sealing engagement.

3. A tool as claimed in claim 1 wherein a hose engaging end of said shaft has a transverse pin extending laterally therefrom selectively engaging detents on a fixture mounted on a shaft engaged end of said hose.

* * * * *